United States Patent [19]

Hand

[11] Patent Number: 4,899,426

[45] Date of Patent: Feb. 13, 1990

[54] METHOD AND APPARATUS FOR RANDOMIZING MULTIPLE YARN STRANDS

[75] Inventor: Edward L. Hand, Belmont, N.C.

[73] Assignee: Belmont Textile Machinery Co. Inc., Belmont, N.C.

[21] Appl. No.: 311,138

[22] Filed: Feb. 15, 1989

Related U.S. Application Data

[63] Continuation-in-part of Ser. No. 226,297, Jul. 29, 1988.

[51] Int. Cl.[4] ..... D02G 3/24; D02G 1/16

[52] U.S. Cl. ..... 28/252; 28/258; 28/271

[58] Field of Search ..... 28/252, 244, 258, 271, 28/274, 282; 57/333, 350, 908

[56] References Cited

U.S. PATENT DOCUMENTS

| | | | |
|---|---|---|---|
| 2,931,090 | 9/1956 | Field, Jr. | 28/252 |
| 3,269,105 | 8/1966 | Eldridge et al. | 28/252 X |
| 3,328,863 | 11/1964 | Cobb et al. | 28/252 X |
| 3,651,630 | 3/1972 | Gemeinhardt | 28/269 X |
| 3,739,566 | 6/1973 | Smith | 28/282 X |
| 4,051,660 | 10/1977 | Griset, Jr. | 57/140 |
| 4,567,720 | 2/1986 | Price | 28/252 X |

*Primary Examiner*—Werner H. Schroeder
*Assistant Examiner*—Jodi A. Tokar
*Attorney, Agent, or Firm*—W. Thad Adams, III

[57] ABSTRACT

A winding apparatus which includes a plurality of yarn supply package stations for holding a plurality of packages of multifilament yarn, a processing station for receiving yarns from the yarn supply packages and processing the yarn, and a take-up package. The improvement comprises a yarn randomizing device positioned downstream from the supply packages and upstream from the processing station for intermixing filaments within a single yarn and among the plurality of yarns in a random and irregular manner before delivery of the yarns to the processing station thereby preventing patterning in the processed yarn, such as a rotating roller having threads thereon for reciprocating the yarns from one side of the roller to the other.

5 Claims, 4 Drawing Sheets

METHOD AND APPARATUS FOR RANDOMIZING MULTIPLE YARN STRANDS

TECHNICAL FIELD AND BACKGROUND OF THE INVENTION

This application is a continuation-in-part of pending application Ser. No. 226,297, filed on July 29, 1988.

This invention relates to a method and apparatus for randomizing multiple yarn strands. In the particular embodiment disclosed in this application, the randomizing apparatus shown comprises a modified winder of the type which includes an air jet entangling station. However, the invention has application on other types of yarn processing equipment as well.

Yarn patterning is a common problem in yarn processing operations. Generally, the problem results from minute differences in yarns being processed, and the tendency for those yarns to behave in a predictable manner based upon their slightly different characteristics relative to one another.

Yarn patterning manifests itself in downstream processes in dyeing variations, streaks, yarns repeating on the surface in knitted or woven fabrics and in carpets. The problem is a particularly difficult one to correct because the problem and, of course, the success of any attempted correction, is not apparent until later processes. It is practically impossible to create absolutely identical yarns or yarn strands.

For example, yarns tend to pass over guides and rollers in a consistent manner, especially after wear has grooved the guides or rollers. In air jet texturing, patterning becomes more of a problem as tension in the process is reduced. If the air jet is a type which does not twist the yarn, the air stream tends to catch the same end of yarn, entangling it in a repeating manner. This shows up in a carpet as a streak or an obviously repeating yarn.

Because it is often desirable to reduce tension for other reasons, yarn patterning tends to become worse and can become so serious that fabric or carpet manufactured from the yarn is not first quality.

It has been found that a vortex can be used to eliminate patterning when combining a plurality of yarns in a process such as winding. Vortex devices have heretofore been used for filament yarn handling as in open end and vortex spinning, where the vortex is used as a twist insertion means.

SUMMARY OF THE INVENTION

Therefore, it is an object of the invention to provide a method and apparatus for randomizing multiple yarns in a yarn process such as a winding process.

It is another object of the invention to provide a method and apparatus for increasing quality in multifilament twisted and air jet textured yarns.

It is another object of the invention to provide a method and apparatus for randomizing multiple yarns in order to mask defects in yarns.

These and other objects of the present invention are achieved in the preferred embodiments disclosed below by providing a winding apparatus which includes a plurality of yarn supply package stations for holding a plurality of packages of multifilament yarn, a processing station for receiving yarns from the yarn supply packages and processing the yarn, and a take-up package. The improvement comprises a yarn randomizing device positioned downstream from the supply packages and upstream from the processing station for intermixing filaments within a single yarn and among the plurality of yarns in a random and irregular manner before delivery of the yarns to the processing station thereby preventing patterning in the processed yarn.

According to one preferred embodiment of the invention, the yarn randomizing device comprises a rotating roller having threads thereon for reciprocating the yarn between the ends of the roller in a random and irregular manner.

According to yet another preferred embodiment of the invention, the processing station comprises an air jet entangler.

According to yet another preferred embodiment of the invention, the invention includes at least one yarn tension reducer.

An embodiment of the method according to the invention comprises the steps of providing a plurality of yarn supply package stations for holding packages of multifilament yarn, a processing station for receiving yarns from the yarn supply packages and processing the yarn, and a take-up package.

The yarn is randomized downstream of the yarn supply package stations and upstream of the processing station for intermixing filaments within a single yarn and among the plurality of yarns in a random and irregular manner before delivery of the yarns to the processing station thereby preventing patterning in the processed yarn.

Preferably, the step of randomizing the yarn comprises the step of passing the moving yarn over a rotating roller having threads thereon. The threads move the yarn and yarn filaments back and forth between the ends of the rotating roller.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
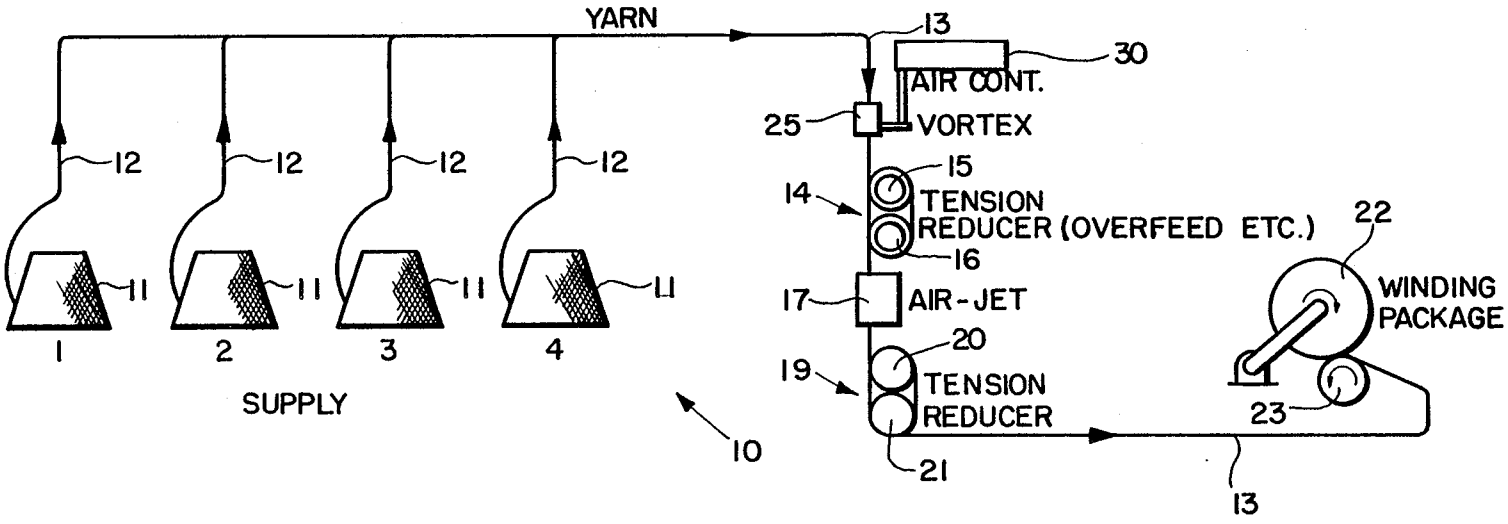
FIG. 1 is a schematic view of an air jet winder of the type described in the application.

Referring now specifically to the drawings, a winding apparatus with a yarn randomizing device according to the present invention is illustrated in FIG. 1 and shown generally at reference numeral 10. Winding apparatus 10 includes a plurality of yarn supply package stations for receiving a yarn supply package 11. Each yarn supply package 11 delivers a yarn 12 to be incorporated into and form a single multi-strand yarn 13.

Yarn 13 is delivered to a first tension reducer 14 comprising a pair of overfeeding rolls 15 and 16, and then to an air jet entangler 17 of conventional design. After entanglement of the yarn 13 occurs, it is fed to another tension reducer 19 comprising a pair of overfeeding rolls 20 and 21. The yarn 13 is then delivered to a winding package 22 driven by a drive roll 23.

Figure 2:
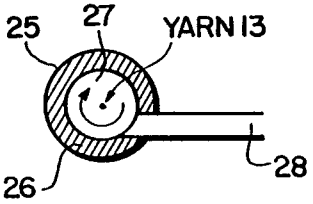
FIG. 2 is a lateral cross-sectional view of the vortex shown in FIG. 1.
Figure 6:
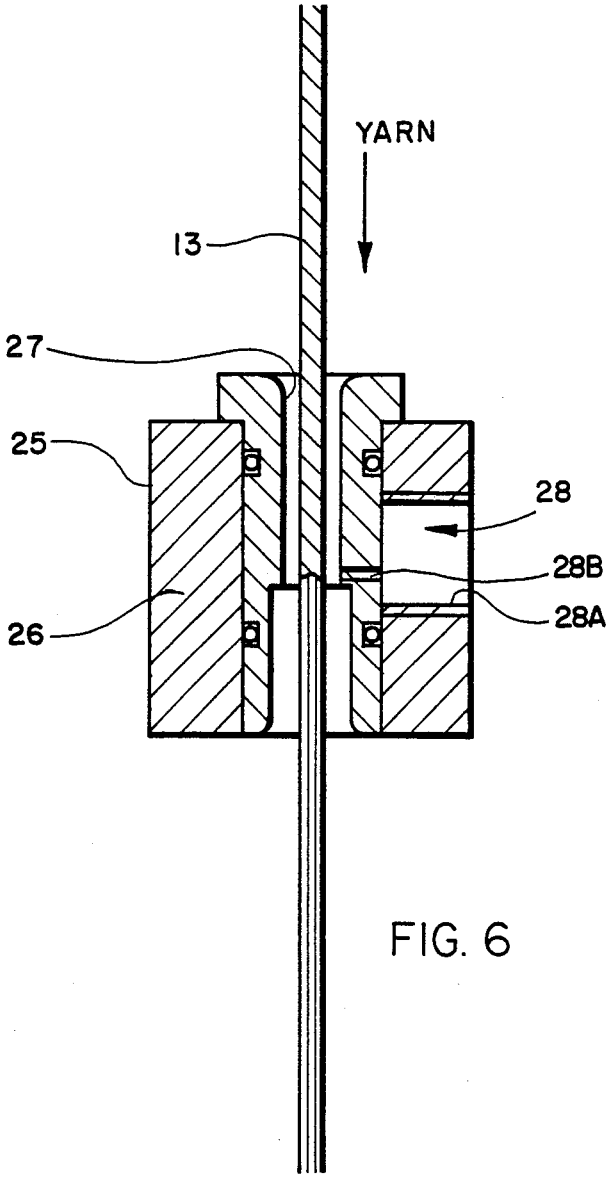
FIG. 6 is a cross-sectional view of a vortex as shown in FIGS. 1, 2 and 3.

A vortex 25 is positioned in the yarn path downstream of the supply packages 11 and upstream of the air jet entangler 17. As in shown in FIG. 2, the vortex 25 comprises a tube 26 having a yarn receiving bore 27 therethrough. An air inlet 28 injects high pressure air into the bore 27 of tube 26, preferably at a tangent to the yarn 13. As is shown in FIG. 6, air inlet 28 comprises relatively large diameter portion **28*a* communicating with a jet hole 28*b* of greatly reduced diameter. Jet hole 28*b* communicates with bore 27 in a perpendicular relationship which causes the air to intersect the yarn at right angles as the yarn passes through bore 27. The tangential orientation of the air onto the yarn imparts a random twisting movement to yarn 13. As a result, the yarn 13 is delivered to tension reducer 14 and to the other downstream stations in a random manner. The randomizing effect can be further enhanced by varying the delivery of the air to the vortex 25, such as by delivering air in pulses or at varying intervals and intensities. These effects are controlled by an air controller 30**.

In accordance with the description above, it has been found that a bore having a diameter of 5/32 of an inch intersecting with a jet hole having a diameter of 1/16 inch provides a desirable structure for the practice of this invention. An air pressure of 30 lbs. per square inch delivers air consumption of 2.4 cubic feet per minute. A yarn speed of 500 yards per minute of a yarn having a count 10×1000 Denier delivers a yarn which is thoroughly randomized as it exits the vortex 25. Of course, many different combinations of air pressure, yarn speed, yarn count and vortex size and configuration are possible.

Figure 3:
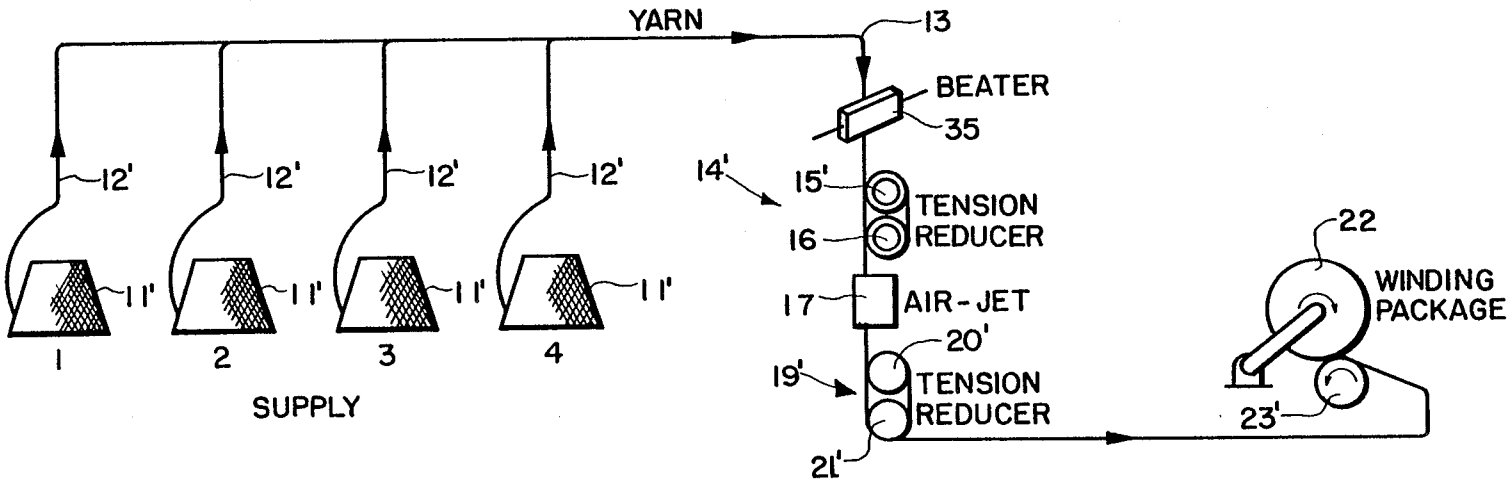
FIG. 3 is a schematic view of an air jet winder of another type described in the application and having a different yarn randomizing device thereon.
Figure 5:
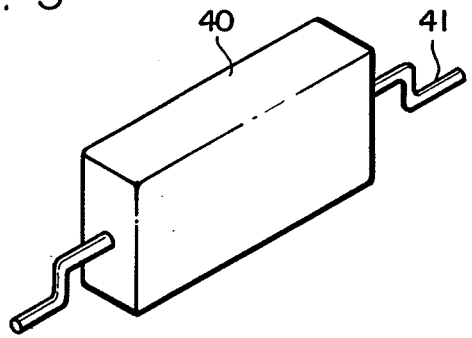
FIG. 5 is a perspective view of a yarn randomizing beater according to another embodiment of the invention.
Figure 4:
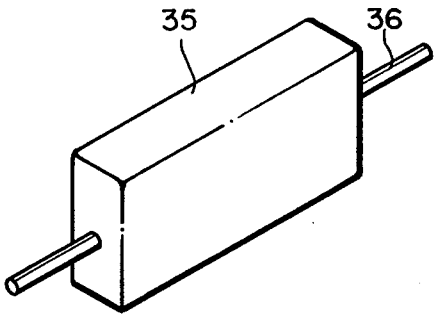
FIG. 4 is a perspective view of the yarn randomizing beater shown in FIG. 3.

Randomizing the yarn 13 can be achieved in a number of ways. Another technique is shown in FIG. 3, where prime reference numerals identify elements in common with FIG. 1. Yarn 13' is randomzed by a beater 35 interposed in the yarn path downstream of the yarn supply packages 11' and upstream from the air jet 17'. In a preferred embodiment, the beater 35 comprises an elongate block having a smooth, snag-free surface mounted for rotation on a shaft 36. As is best shown in FIG. 4, beater 35 is rectangular in cross-section. As the beater 35 rotates, it reorients the relative position of the yarns 12 as they pass. The effect on the yarns can be made even more random by placing a bend in the shaft, as is shown in FIG. 5 where a beater 40 is shown mounted eccentrically on a bent shaft 41. Many other arrangements are possible, such as further random variations in the shape of the surface of the beaters 35 and 40, and in the shape and axis of rotation of the shafts 36 and 41. Variations in the speed of rotation of the beaters 35 and 40 in a random manner can further enhance the randomizing effect on the yarns 12.

Figure 7:
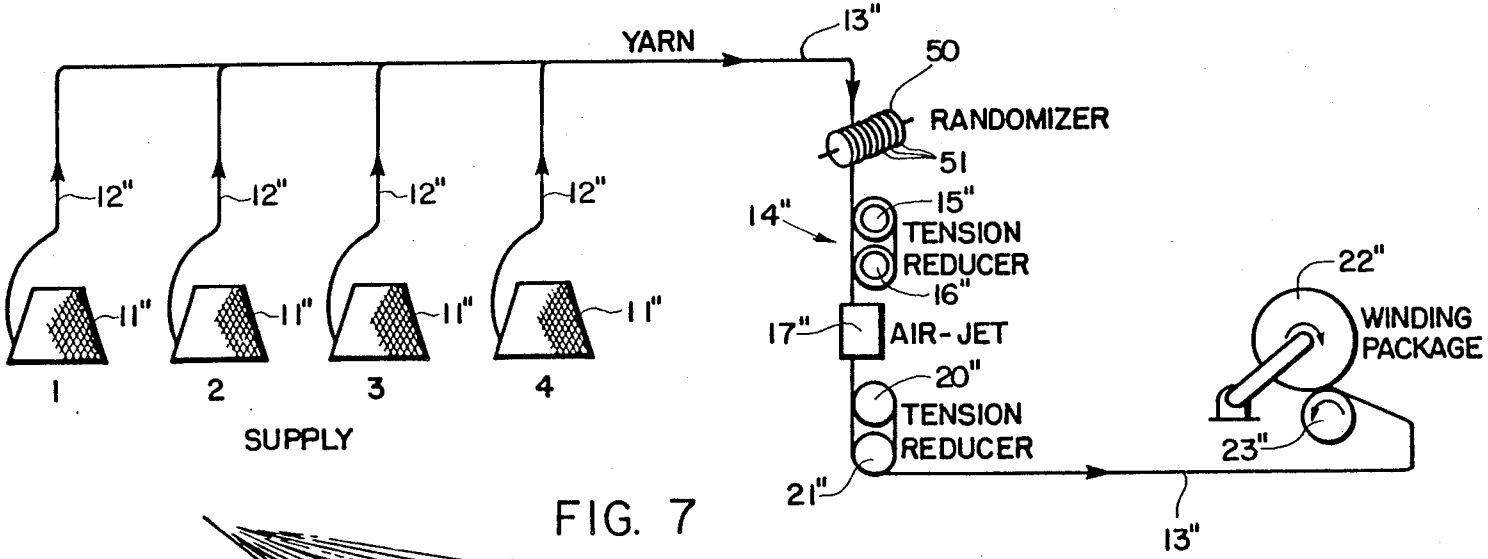
FIG. 7 is a schematic view of an air-jet winder having a threaded roller type of randomizer.

Referring now to FIG. 7, yet another embodiment of the invention is shown where double prime reference numerals identify elements in common with FIGS. 1 and 3. Yarn 13'' is randomized by a roller 50 which is rotated by frictional contact with the moving yarn 13''. Roller 50 is provided with threads 51 around its periphery in which yarn 13'' rides. Threads 51 move yarn 13'' from one end of roller 50 to the other as roller 50 rotates. The distance along roller 50 which the yarn 13'' will move during one reciprocation depends on the speed and tension on the yarn 13''. As yarn 13'' moves along roller 50 from its centerline the tension on the yarn increases. When the tension on yarn 13'' is great enough, yarn 13'' will pull out of the thread 51 in which it resides and spring back toward the center of roller 50, and will usually overshoot the center of roller 50 and come to rest in a thread 51 on the other end of roller 50. Because of constant variations in tension, yarn 13'' will tend to pull out of a different thread on each reciprocation and come to rest in a different thread on the other end of roller 50. Within this random movement exists separate movement of filaments which may at various times all rest in the same thread 51 or may separate and ride in different threads 51.

Figure 8:
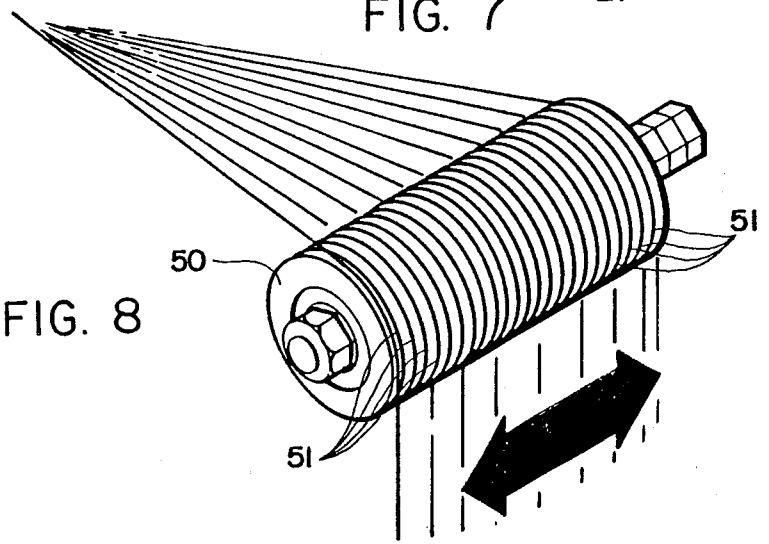
FIG. 8 is a fragmentary perspective view of he threaded roller type of randomizer.

As is illustrated in FIG. 8, rapid linear movement of the yarn 13'' will cause an equally rapid random reciprocation of yarn 13'' having the effect of eliminating patterning in the yarn. Different sizes of rollers 50 having different depth, width and pitch of threads 51 may be used depending on the type of yarn being processed. In one preferred embodiment, a roller fabricated of aluminum 70 mm long and 20 mm in diameter is used. The threads are 2 mm deep, 2 mm wide and have a pitch of 2 mm. The shape of the threads is that of a standard machine thread.

The randomizing effect occurs not only in the relation of the yarns 12 to each other in the multi-strand yarn 13, but also in the relationship of the filaments within each yarn 12. The result is a thoroughly randomized yarn 13 which not only will insure that variations in otherwise first quality yarns do not repeat in an obvious manner, but also will also mask many defects in yarn which would otherwise require the yarn to be used only for second quality fabrics or carpets.

A method and apparatus for randomizing yarn is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. In a winding apparatus including a plurality of yarn supply package stations for holding packages of multifilament yarn, a processing station for receiving yarns from the yarn supply packages and processing the yarn, and a take-up package, the improvement which comprises randomizing means positioned downstream from the supply packages and upstream from the processing station for intermixing filaments within a single yarn and among the plurality of yarns in a random and irregular manner before delivery of the yarns to the processing station thereby preventing patterning in the processed yarn, said randomizing means comprising a roller having threads thereon for randomly reciprocating said filaments along the length of said roller between two ends thereof.

2. In a winding apparatus according to claim 1, wherein said processing station comprises an air jet entangler.

3. In a winding apparatus including a plurality of yarn supply package stations for holding packages of multifilament yarn, a processing station for receiving yarns from the yarn supply packages and processing the yarn, and a take-up package, and at least one yarn tension reducer, the improvement which comprises randomizing means positioned downstream from the supply packages and upstream from the processing station for intermixing filaments within a single yarn and among the plurality of yarns in a random and irregular manner before delivery of the yarns to the processing station thereby preventing patterning in the processed yarn said randomizing means comprising a roller having threads thereon for randomly reciprocating said filaments along the length of said roller between two ends thereof.

4. In a winding apparatus according to claim 3, wherein said processing station comprises an air jet entangler.

5. A method of winding yarn, comprising the steps of:

(a) providing a plurality of yarn supply package stations for holding packages cf multifilament yarn, a processing station for receiving yarns from the yarn supply packages and processing the yarn, and a take-up package;

(b) randomizing the yarn downstream of the yarn supply package stations and upstream of said processing station for intermixing filaments within a single yarn and among the plurality of yarns in a random and irregular manner before delivery of the yarns to the processing station thereby preventing patterning in the processed yarn by passing the yarn filaments across a rotating roller having threads thereon.

* * * * *